United States Patent [19]

Runyon

[11] 4,345,503

[45] Aug. 24, 1982

[54] INTERCHANGEABLE TONE CHAMBER

[76] Inventor: Clinton A. Runyon, 174 Emerite Dr., Lafayette, La. 70506

[21] Appl. No.: 274,661

[22] Filed: Jun. 17, 1981

[51] Int. Cl.[3] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 2,397,593 | 4/1946 | Brilhart | 84/383 R |
| 2,530,155 | 11/1950 | De Luca | 84/383 R |
| 3,202,032 | 8/1965 | Strathmann | 84/383 R |
| 4,212,223 | 7/1980 | Runyon | 84/383 R |

*Primary Examiner*—Lawrence R. Franklin

*Attorney, Agent, or Firm*—Harvey B. Jacobson

[57] ABSTRACT

A mouthpiece for use with single reed woodwind musical instruments, such as saxophones, clarinets, and the like, includes a secondary reed containing a wedge-shaped element built on one end thereof, the secondary reed being contained within the interior of the mouthpiece and interchangeable with other secondary reeds having juxtaposed thereon wedges of various sizes to alter the tone of the instrument. The secondary reed is held in position in the interior of the mouthpiece by a pair of retaining grooves placed in opposite sides of the mouthpiece and which receive opposite side edges of the secondary reed which is positioned into and out of the interior of the mouthpiece by simply sliding the secondary reed within the pair of retaining grooves.

8 Claims, 5 Drawing Figures

INTERCHANGEABLE TONE CHAMBER

BACKGROUND OF THE INVENTION

Field of the Invention

This invention relates to improvements in woodwind musical instrument mouthpieces, and in particular to improvements to the mouthpieces which enable variations in the tone quality of the instrument. Specifically, the invention contemplates a modification of the mouthpiece for single reed instruments, such as clarinets and saxophones, wherein an independent and interchangeable secondary reed having mounted thereon a wedge is positioned inside the hollow mouthpiece chamber, the secondary reed vibrating sympathetically when the primary reed is placed in vibrating motion during ordinary use of the instrument to which the mouthpiece is attached and the wedge altering the cross-sectional area of the tone chamber of the mouthpiece.

Disclosure Statement

Interchangeable wedge-shaped members have been positioned within the interior of mouthpiece chambers of woodwind instruments in order to change the cross-sectional area of the chamber and thereby modify the tone quality which is produced. Such structures are shown in U.S. Pat. Nos. 2,397,593, issued Apr. 2, 1946, to Brilhart; 3,202,032, issued Aug. 24, 1965, to Strathmann; and 2,530,155, issued Nov. 14, 1950, to DeLuca. U.S. Pat. No. 4,041,827, issued Aug. 16, 1977, to Daglis, discloses a tone enhancing element which is incorporated within the mouthpiece of a reed instrument, the element having two steps projecting into the air flow-through passage of the mouthpiece at a point opposite the opening over which the reed is mounted. U.S. Pat. Nos. 2,224,719, issued Dec. 10, 1940, to Brilhart and 2,499,855, issued Mar. 7, 1950, to Gamble, disclose adjusting the tone quality of woodwind instruments by including means which contact the primary reed in order to alter the tone quality produced by the instrument. Another mouthpiece is disclosed in U.S. Pat. No. 1,583,382, issued May 4, 1926, to Bauer, wherein a single piece of stamped bifurcated metal is secured to the inside surface of the mouthpiece, where functioning depends on a critical position in the mouthpiece of the inserted piece of metal in order to accomplish tone alteration. In U.S. Pat. No. 4,212,223, issued July 15, 1980, to the present inventor, a mouthpiece for a woodwind musical instrument is disclosed which contains a primary reed and a secondary reed positioned within the interior of the mouthpiece and which is positioned substantially parallel to the primary reed. While the inventor's prior patent has proven successful in altering the tonal quality of reed instruments, the present invention provides an interchangeable member which combines a secondary reed with a wedge-shaped member placed thereon to alter the tone quality of the reed instrument. None of the other mentioned patents contains a disclosure of a secondary reed suspended in the instrument mouthpiece tone chamber substantially parallel to the primary reed, nor do any of the patents disclose the interchangeable tone-altering member of the present invention which includes a combination of a sympathetically vibrating secondary reed and a wedge-shaped member placed thereon which alters the cross-sectional area of the tone chamber.

SUMMARY OF THE INVENTION

In accordance with the present invention, a woodwind musical instrument mouthpiece is provided in the interior thereof with an interchangeable tone-altering member comprising a secondary reed which vibrates inside the tone chamber of the mouthpiece for the purpose of adding intensity and character to the tone quality when the mouthpiece is played with an associated appropriate musical instrument and which includes on one end thereof a wedge-shaped member which alters the size of the tone chamber and thereby further changes the tone produced by the instrument. The instruments which are particularly contemplated for modification according to the teachings of the present invention include but are not limited to various types of clarinets and saxophones, such as a B-flat clarient, an alto clarinet, a bass clarinet, and the like; also contemplated are alto saxophones, tenor saxophones, baritone saxophones, soprano saxophones, bass saxophones, and the like. The interchangeable tone-altering element is preferably mounted within the interior of the tone chamber such that the secondary reed is positioned in a plane substantially parallel to the plane of the longitudinal extent of the tone chamber. The wedge-shaped member is positioned on the flat side of the secondary reed facing the primary reed and is positioned on the secondary reed at the end nearest the opening of the mouthpiece. The wedge-shaped member tapers in the direction of the opening of the mouthpiece. The combined tone-altering member is positioned within the interior of the tone chamber and moved therein by a pair of retaining grooves which are formed along the interior surface on opposite sides of the tone chamber. By varying the sizes of the wedge, the interchanging of the combined tone-altering element will thus modify the tone or sound of the instrument and allow the individual artist to produce the varying types of sound which may be required.

Accordingly, it is an object of the present invention to provide a mouthpiece for reed instruments, wherein the mouthpiece is provided with an interchangeable tone-altering member mounted within the mouthpiece for altering the tone produced by the instrument.

Another object of the invention is to provide an interchangeable tone-altering member which can be positioned within the interior of the mouthpiece of a wind instrument, the tone-altering member comprising a secondary reed which vibrates sympathetically within the tone chamber of the musical instrument mouthpiece and a wedge positioned on one end of the secondary reed for altering the cross-sectional area of the tone chamber.

Still another object of the invention is to provide a mouthpiece for a wind instrument with an interchangeable tone-altering member formed of a secondary reed which vibrates sympathetically with the primary reed of the instrument and which further includes a wedge positioned on one end of the secondary reed for altering the cross-sectional area of the tone chamber, the interchangeable member being positioned into and out of the interior of the tone chamber by means of a pair of retaining grooves.

Still yet another object of the invention is to alter the tone quality of a reed instrument by incorporating within the interior of the tone chamber of the instrument an interchangeable tone-altering member which comprises a secondary reed which vibrates sympathetically with the primary reed and a wedge-shaped member which is positioned at one end of the secondary reed and which alters the cross-sectional area of the tone chamber.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
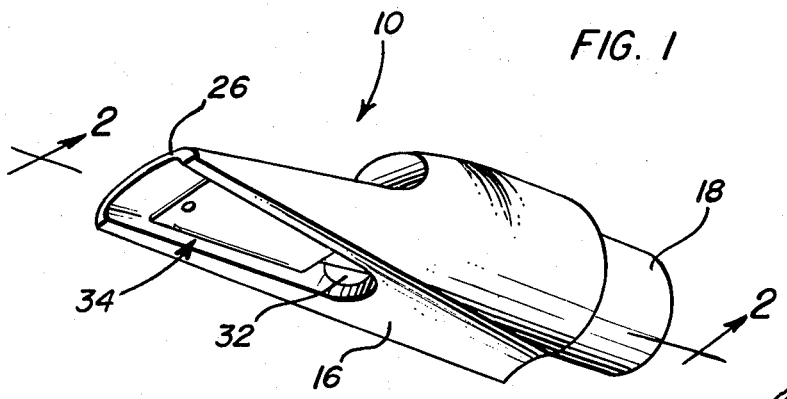
FIG. 1 is a perspective view of a mouthpiece for use with a reed instrument and illustrating the placement of the tone-altering member of the present invention within the tone chamber.
Figure 2:
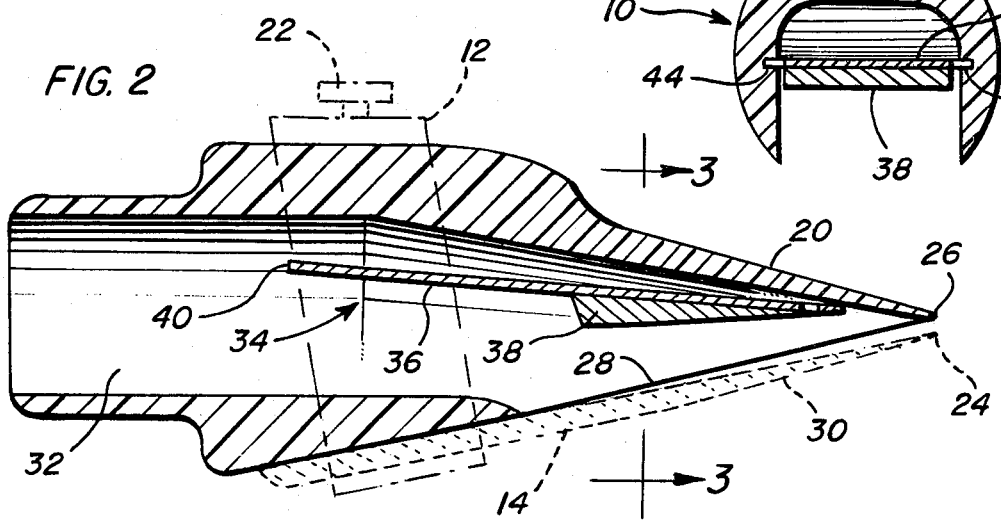
FIG. 2 is a longitudinal sectional view of the mouthpiece of FIG. 1 showing the placement of the tone-altering member within the tone chamber, the primary reed and holding device therefor shown in phantom.

The mouthpiece for single reed instruments is conventionally carved from wood or plastic, or, if made from plastic, can be made by conventional lost wax casting or molding techniques. Although varying somewhat in size, external appearance, and shape, according to the intended instruments with which the mouthpiece is to be used, the general configuration and structure of mouthpiece to be used with various single reed musical instruments is shown in FIGS. 1 and 2, wherein a mouthpiece frame 10 is illustrated, over which a tapered annular ligature 12 slides in order to retain primary reed 14 in contact with the lower surface 16 of mouthpiece 10. Mouthpiece frame 10 is made up of tubular connection 18 for insertion within the upper end of a conventional wind instrument body (not shown), and frame 10 also has an inclined wall 20 against which the musical performer's upper lip rests during operation of the instrument. Thumb screw 22 passes through a through hole in ligature 12, with rotation of thumb screw 22 effecting tightening action of ligature 12 against the lower surface 16 of mouthpiece frame 10 to hold primary reed 14 in place. The construction and operation of ligature 12 is standard and conventional and does not relate to the operation or mounting of the tone-altering member of the present invention.

Referring now to FIG. 2, primary reed 14 can be seen held in place against lower surface 16 of mouthpiece frame 10 by ligature 12. Primary reed 14 is conventionally cut out of elastic reed plates, such as cane, and tapers to primary reed edge 24, which projects somewhat below arcuate end 26 of inclined wall 20 of mouthpiece frame 10, leaving a chink through which the musician blows in order to set tapered edge 24 in vibratory motion in conventional operation of the instrument. Vibrations of primary reed 14 set the entire column of air in the instrument in motion, and reinforcement from waves of air which arise in the interior of the instrument produces an alternation in the pressure of air adjacent to reed 14 sufficiently powerful to make it vibrate sensibly. The tones produced by instrument has a pitch determined by the length of the column of air in the instrument, the acoustic length of which can be altered by opening the side holes located in the body (not shown) of the instrument. The time of vibration of primary reed 14 consists of the time of forward motion, the time of rest, and the time of recoil. When the reed is placed in the mouth, the air pressure on inside surface 28 of reed 14 is equal to the pressure against outside surface 30 of reed 14. As the musician blows through the chink, a suction is created against inside surface 28, drawing edge 24 in the direction of end 26 after the pulse of compressed air exits at the first found point of outlet on the musical instrument, external air then rushes in to restore equilibrium and cause edge 24 of reed 14 to recoil. Cyclic repetition of this process sets the entire column of air within mouthpiece frame 10 and the associated instrument body (not shown) in periodic motion which generates the acoustic tone or sound characteristic of the musical instrument. Accordingly, the air within mouthpiece tone chamber 32 oscillates to form a wave characteristic of the musical instrument with its side holes opened as desired by the musician to generate the desired tone. Positioned within tone chamber 32 is the tone-altering member 34 of the present invention comprising secondary reed 36 and wedge 38. The oscillatory motion of the air within tone chamber 32 sets secondary reed 36 into sympathetic vibration and causes a modification in the tone quality obtained. Similarly, the thickness of wedge 38 alters the cross-sectional area of tone chamber 32 and thus the column of air which is set in motion in tone chamber 32 and thereby further modifies the tone quality obtained from the musical instrument.

The phenomenon of sympathetic resonance is well-known to musicians. When, for example, the strings of two violins are tuned to the same pitch, and one string is bowed, the other will begin to vibrate. Even when the pitch of the primary sounding body is not exactly that of the sympathetically vibrating body, the latter will nevertheless often make sensible sympathetic vibrations, which diminish in amplitude as the difference of pitch increases. Light elastic bodies which offer little resistance can be more easily adapted to vibrate sympathetically to a primary tone than massive elastic bodies. Moreover, sympathetic vibration can also be induced corresponding to the harmonic upper partial tones of the primary body. The mode of transmission from a primary vibrating body to a secondary vibrating body is well-known in the theory of sound, involving principles of wave motion observable in response to periodic changes in air pressure created by mechanical motion. Accordingly, when primary reed 14 begins to vibrate by movement of edge 24 alternately toward and away from end 26 of mouthpiece frame 10, thereby setting in oscillatory motion the air in tone chamber 32 and producing the characteristic combination of proper and harmonic tones which are unique to the particular instrument with which the mouthpiece is associated, sympathetic reed 36 begins to vibrate through the action of the oscillatory motion of the air within tone chamber 32, with end 40 of secondary reed 36 describing vibratory motion in a direction essentially perpendicular to its plane. The addition of a sympathetic reed within the tone chamber of the mouthpiece of a wind instrument is disclosed in U.S. Pat. No. 4,212,223, issued to the present inventor. By incorporating a secondary reed within the tone chamber of the mouthpiece, it was found that the tone quality of the instrument is altered and that greater intensity and character of the tone quality results. Aesthetically speaking, use of the invention adds another dimension to the tone and adds life to the tone. With the use of a secondary reed, not only is the quality of the musical experience enhanced, but the musician is capable of achieving a wider variety of artistic effects, in somewhat the same manner as a musician playing a trumpet or trombone with an added mute or a musician playing a violin or viola when modifying the tone quality with an appropriate muting device. Unlike the various known muting devices, however, a secondary reed does not shade the tone quality toward a more subdued or mellow character, but instead achieves the opposite tone modification, by adding extra intensity, character and life without detracting therefrom.

Figure 4:
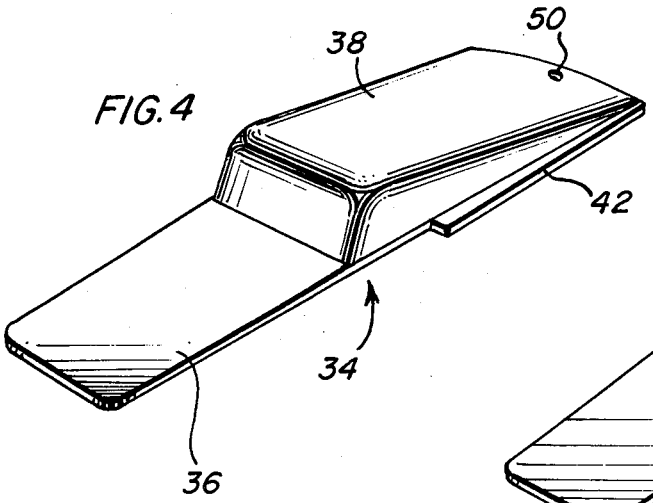
FIG. 4 is a perspective view illustrating the combined tone-altering member of the present invention.

The present invention is an improvement on the earlier patented secondary reed. In accordance with the present invention and as illustrated in FIGS. 2 and 4, tone-altering member 34 comprises secondary reed 36 and wedge 38 which is built on one end of secondary reed 36 and which is also placed within tone chamber 32. Wedge 38 alters the tone chamber so that it comprises a smaller cross-sectional area, and thereby changes the tone quality of the instrument to a thinner, more piercing type of tone and further increases the volume. The thicker the wedge 38, the louder the tone emanating from the musical instrument will be. As can be seen, wedge 38 is placed on secondary reed 36 so as to face and lie in a plane substantially parallel to primary reed 14. The wedge tapers in a direction from the interior of tone chamber 32 toward end 26 of surface 20.

Tone-altering member 34 can be constructed of the same material as mouthpiece frame 10. Secondary reed 36 and wedge 38 can be made as an integral unit or the two members can be formed separately and bonded together by either a separate bonding agent or fused together if formed from plastic. Accordingly, tone-altering member 34 can be made of metal, wood, cane, or plastic.

Although the invention has been described and illustrated with respect to modification of a single reed mouthpiece, such as that in use with saxophones and clarinets of various types, the concept of the invention can be extended to modify a tone quality of double reed instruments, such as the oboe, bassoon and English horn. Materials of construction for mouthpiece 10 can vary, including the plastic illustrated in the drawings, but also encompassing metal, hard rubber, and the like. Moreover, primary reed 14 can be selected from a plurality of possible construction materials, including plastic, elastic wood, French cane, and the like.

Figure 3:
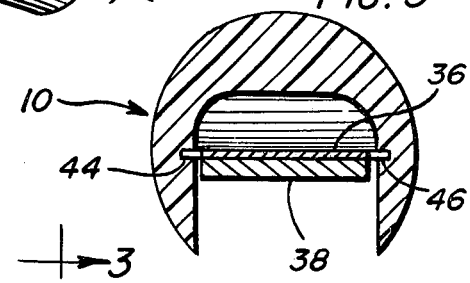
FIG. 3 is a transverse sectional view illustrating the placement and retention of the tone-altering member of the present invention within the mouthpiece by means of a pair of retaining grooves.
Figure 5:
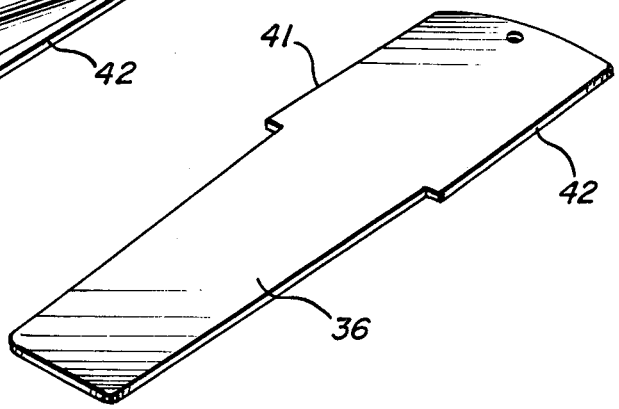
FIG. 5 is a view of the secondary reed without the wedge and illustrating the pair of mounting flanges.

An important feature of the present invention relates to the interchangeability of tone-altering member 34. Accordingly, various sizes and types of second reeds 36 can be associated with wedges 38 of various thicknesses so as to allow the musician to change the tone quality of the instrument by simply interchanging the various tone-altering members 34. Referring to FIGS. 3, 4 and 5 it can be seen that tone-altering member 34 is provided with a pair of mounting flanges 41 and 42 which are formed on opposite sides of reed 36 at the end which supports wedge 38. Flanges 41 and 42 fit within a pair of longitudinal retaining grooves 44 and 46 formed in the interior of mouthpiece 10. Accordingly, simply by placing tone-altering member 34 within tone chamber 32 such that flanges 41 and 42 are retained within grooves 44 and 46, tone-altering member 34 is maintained in place. To remove one particular tone-altering member 34 and replace it with another, one simply inserts a pointed object into hole 50 placed at the outer end of wedge 38 and slides tone-altering member 34 such that flanges 41 and 42 are no longer retained within grooves 44 and 46. It can be seen that primary reed 14 needs to be removed prior to removing tone-altering member 34.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a mouthpiece for a woodwind musical instrument wherein the mouthpiece comprises a hollow mouthpiece frame and a primary reed, the frame defining an interior tone chamber having an end for attachment to a length of tubular instrument body and having a chink opening between said primary reed and said mouthpiece for blowing of air therethrough to produce a musical tone, the improvement comprising a tone-altering member mounted within said tone chamber, said member comprising a secondary reed for vibrating sympathetically with said primary reed and a wedge mounted to said secondary reed, said secondary reed and said wedge modifying the tone produced.

2. The improvement of claim 1 wherein said tone chamber is elongated and has a longitudinal extent, said secondary reed being disposed substantially parallel to said longitudinal extent.

3. The improvement of claim 2 wherein said tone-altering member is provided with a hole placed at the end closest to said end of the mouthpiece when said tone-altering member is positioned within said tone chamber, said hole allowing the insertion of an object to slidingly remove said tone-altering member from said tone chamber.

4. The improvement of claim 1 wherein said wedge is positioned on said secondary reed along the portion of said secondary reed closest to the outer end of said mouthpiece.

5. The improvement of claim 4 wherein said wedge is positioned on a side of said secondary reed facing said primary reed.

6. The improvement of claim 5 wherein said wedge tapers toward the end of said mouthpiece.

7. The improvement of claim 1 wherein said secondary reed has a mounting portion and a sympathetically vibrating portion, the mounting portion being secured to the inside surface of said hollow mouthpiece and the vibrating portion being directed substantially parallel to the longitudinal extend of said tone chamber.

8. The improvement of claim 7 wherein said mounting portion comprises a pair of flanges which extend beyond the width of said wedge, said inside surface being provided with a pair of retaining grooves positioned on opposite sides of said tone chamber, said retaining grooves slidingly retaining said extended flanges.

* * * * *